US006772714B2

(12) United States Patent
Laird et al.

(10) Patent No.: US 6,772,714 B2
(45) Date of Patent: Aug. 10, 2004

(54) ELECTRONIC FAN CONTROL

(75) Inventors: David Rick Laird, Waterloo, IA (US); James Hugh Ross, Cedar Falls, IA (US); Barry Edward Plassman, Cedar Falls, IA (US); Gary John Treichel, Cedar Falls, IA (US); Douglas Robert Fischer, Parkersburg, IA (US); James Anton Miller, Cedar Falls, IA (US); Michael John Pipho, Dunkerton, IA (US)

(73) Assignee: Deere & Company, Moline, IL (US)

( * ) Notice: Subject to any disclaimer, the term of this patent is extended or adjusted under 35 U.S.C. 154(b) by 70 days.

(21) Appl. No.: 10/218,871

(22) Filed: Aug. 14, 2002

(65) Prior Publication Data

US 2003/0041814 A1 Mar. 6, 2003

Related U.S. Application Data

(60) Provisional application No. 60/312,730, filed on Aug. 16, 2001.

(51) Int. Cl.[7] ..... F01P 3/22
(52) U.S. Cl. ..... 123/41.12
(58) Field of Search ..... 123/41.12, 41.49

(56) References Cited

U.S. PATENT DOCUMENTS 4,546,742 A * 10/1985 Sturges ..... 123/41.12
4,658,764 A * 4/1987 Miura et al. ..... 123/41.12
5,669,336 A * 9/1997 Williams ..... 123/41.12
6,308,664 B1 * 10/2001 Ambros ..... 123/41.12

* cited by examiner

*Primary Examiner*—Noah P. Kamen

(57) ABSTRACT

Method and apparatus for controlling a cooling fan in a vehicle engine compartment, such as a tractor or combine. A fan control receives inputs from sensors and uses the sensor inputs in determining fan speeds which meet cooling needs while limiting fan energy consumption. Sensor data include at least one of PTO and transmission settings, throttle command and engine speed, and fan speed and air conditioner settings. Sensor data is received and processed in the fan control, which sends the greatest determined fan speed to a fan actuator. When the PTO is activated and the transmission is in park, fan speed can be controlled according to an alternate coolant temperature table. When throttle command is zero and engine speed is above a maximum, fan speed is set at maximum. When air conditioning is activated, fan speed is set at least at a predetermined minimum speed.

21 Claims, 2 Drawing Sheets

ELECTRONIC FAN CONTROL

This application claims the benefit of U.S. Provisional Application No. 60/312,730, filed Aug. 16, 2001.

BACKGROUND OF THE INVENTION

This invention relates to controlling the rotational speed of a rotational output part of a fan used for cooling components of a motor vehicle. Typically, such fan is driven by a viscous friction clutch which is coupled to a driving rotational part by way of a shearing fluid whose effective fluid quantity determines the transferable torque. Such driving rotational part is typically driven, directly or indirectly, by the prime energy supply (e.g. internal combustion engine) of the vehicle.

Arrangements of this type are used, for example, for controlling the rotational speed of a fan for cooling motor vehicle components such as engines, engine fluids, and vehicle accessories. In such cases, the fan can be coupled to the vehicle engine by way of the fluid friction coupling. Alternatively, the fan can be driven by a separate electric motor, powered from the vehicle electrical system, through an electrical control system. Accurate cooling control is essential for efficiency gains related to engine compartment cooling.

Whether the fan is driven by a viscous friction coupling to the engine drive shaft, or by a separately powered electric motor, activation of the fan, and control of fan speed, are controlled by a control system. Improved such control systems are the subject of this invention. Thus, while the remainder of this disclosure is directed to controlling a viscous friction coupling, or clutch, which drives the cooling fan, the same inventive parameters can as well be applied to a fan which is driven by an electric motor separately powered from the vehicle electrical system and not directly connected to the mechanical power developed by the prime energy source which serves as the general power source for the vehicle.

A wide range of applied cooling capacities are required by motor vehicles, depending on the conditions in which the vehicles are operated, as well as the loads being placed on a vehicle, on the engine, on engine components, and on vehicle accessories. The degree of cooling required during engine operation varies from a low level under light load conditions in cool weather, to a high level under heavy load conditions in hot and humid weather.

The fan is used to provide cooling air flow for diverse engine-related and vehicle-related media, such as engine coolant, charge air, engine oil, transmission oil, and retarder oil. The fan is also used, as required, for cooling refrigerant of an air conditioning system.

The fan is typically positioned rearwardly, in the vehicle, of such cooling devices as a coolant radiator, an air conditioner heat exchanger/condenser, a transmission oil cooler, and the like, which are typically positioned behind the grill at the front of the vehicle. Thus, operation of the fan draws ambient cooling air under a low negative pressure through such forwardly-disposed devices, thereby assisting in transfer of heat from such devices to the ambient air.

Correspondingly, the fan is typically placed frontwardly, in the vehicle, of the vehicle engine or other main heat source, whereby the air drawn through e.g. the one or more forwardly-disposed heat exchangers, radiators, is expelled from the fan and blown under a small positive pressure toward the rear of the vehicle and over the engine block and other heat-producing components in the engine compartment, thus to dissipate heat to the so-expelled ambient air.

The operation of a single fan is thus used to provide cooling air, and corresponding heat dissipation, to a substantial number of heat sources, each of which has a different requirement for heat dissipation. All such heat sources can tolerate operating at conditions wherein an external surface of the heat source is at ambient temperature. All such heat sources have high temperature limits which cannot safely be exceeded. Some such heat sources have optimum temperatures or temperature ranges whereat efficiency is improved or optimized.

Historically, the fan was run at such cooling capacity that all cooling needs were intentionally exceeded, and whereby no further control of the fan was exercised, and no monitoring of temperatures was used in fan control. However, such intentional overcooling, in combination with the lack of use of temperatures in controlling fan speed, can result in reduced efficiencies in some heat sources, and undetected overheating of one or more such heat sources.

More recently, conventional practice is that various parameters representing existing engine and vehicle e.g. heat-related conditions are fed into a controller which processes the various inputs, determines a desired fan speed, and sends a signal corresponding to the desired fan speed, to the viscous clutch or electric motor, whichever is running the fan. Referring to the viscous clutch embodiments, the signal is received by an actuator on the viscous clutch, which actuates the clutch to adjust the effective amount of shearing which takes place in the clutch, thereby to adjust the speed of rotation of the fan. When more cooling is needed, the speed of the fan is increased. When less cooling is needed, the speed of the fan is reduced.

For this purpose, the viscous clutch has a storage chamber and a working chamber which encloses a rotational driving part in the form of a driven coupling disk and between which an inflow path and a return flow path, respectively, are provided for shearing fluid circulation. Such circulation is caused by a circulation pump which pumps the shearing fluid from the working chamber into the storage chamber. The valve, which can be actuated by e.g. a solenoid, controls the shearing fluid circulation and thus the quantity of shearing fluid which is, in each case, situated in the working chamber which is available as the effective fluid quantity for the transmission of torque.

Friction fluid couplings with timed electric driving of an adjusting unit for the variable adjusting of the effective shearing fluid quantity are disclosed in EP 0 009 415 B1.

U.S. Pat. No. 4,828,088 Mohan et al, which is herein incorporated by reference in its entirety, teaches sensing coolant temperature and adjusting fan speed according to the sensed coolant temperature.

U.S. Pat. No. 5,584,371 Kelledes et al, which is herein incorporated by reference in its entirety, teaches sensing engine speed, coolant temperature, nominal engine temperature, fan speed, and whether the air conditioner is on or off, and adjusting fan speed accordingly.

U.S. Pat. No. 5,947,247 Cummings III, which is herein incorporated by reference in its entirety, teaches a continuously variable fan output speed, and electric control circuitry which continues to alter the signal to the control valve until the sensed speed matches the desired speed. The controller is provided with a series of processing algorithms which respond to the signals from the sensors which sense the sensed conditions. The algorithms provide response signals appropriate to the sensed conditions, and thereby determine the desired fan speed. Named sensed parameters are fan drive oil temperature, engine coolant temperature, charge air temperature, hydraulic oil temperature, and engine speed.

U.S. Pat. No. 6,079,536 Hummel et al teach a temperature stage analysis in the controller feeding a rotational stage speed controller, and multiple speed demand units in parallel, wherein the signal with the highest rotational speed demand, including incorporation of correction adjusting signals, is selected for implementation of fan speed. The parameters sensed are retarder temperature, charge air temperature, engine coolant temperature, air conditioner on or off, engine speed, engine torque, momentary speed of the coupling disc of the friction clutch, actual fan speed, fan drive speed, desired fan speed, and engine brake demand. The various demand signals are fed in parallel to a maximum value selection controller, along with certain correction signals, thereby to arrive at a desired fan speed, which is then transmitted to an actuator which implements such fan speed at the fan.

The purpose of such controlling of fan speed is to ensure that adequate cooling is provided while limiting the amount of energy consumed in the process of providing such cooling.

And while certain advances have been made, in certain instances, the cooling protocols and algorithms of the known art provide more cooling than is required or desired, and in other instances, such protocols and algorithms of the known art provide less cooling than is required, or desired.

It is an object of the invention to further refine the art of control of vehicle engine cooling fans by controlling the fan speed using alternative and additional control parameters.

More specifically, it is an object of the invention to provide a control sequence which applies a temporarily higher coolant temperature when the vehicle transmission is in Park while a power-take-off unit (PTO) is in operation.

Also more specifically, it is an object of the invention to provide a control sequence which engages the fan at maximum driven speed when the vehicle throttle command is zero and engine rotational speed exceeds a predetermined speed.

It is yet another specific object to provide for a minimum fan speed when the vehicle air conditioning system is in operation.

SUMMARY OF THE INVENTION

Method and apparatus for controlling rotational speed of a cooling fan in the engine compartment of a mobile vehicle. The purpose of the cooling fan is to dissipate heat generated by operation of the vehicle. A fan control unit receives inputs from a number of sensors and uses such sensor inputs in determining a fan speed which meets various requirements of the vehicle cooling needs while limiting the amount of energy consumed by the fan, and in some instances, improving efficiency of one or more of the operating parameters of the vehicle.

In a first family of embodiments, the invention comprehends a method of controlling rotational speed of a cooling fan positioned to provide primary cooling to at least one of an engine, vehicular fluids, or vehicular accessories in a motor vehicle having a primary energy source, and a transmission. The method comprises supplying sensor data from multiple sensors sensing heat-related information, to a fan control unit. The sensor data include at least one of (i) power-take-off activation and whether the transmission is in park, (ii) throttle command and engine speed, and (iii) fan speed and when an air conditioning system of the vehicle is activated. The method further includes receiving the sensor data into the fan control unit and processing the sensor data according to one or more pre-programmed algorithms, and thereby determining minimum fan speed demands according to respective individual data inputs as well as according to data representing selected sets of data inputs from respective different data sensors and thereby developing a set of minimum fan speed determinations; selecting from the set of most current fan speed determinations, that fan speed determination which represents the greatest fan speed; and sending, to an actuator on the fan, a fan actuation signal corresponding to the selected fan speed thereby to activate control of the fan to the selected fan speed. The method yet further comprises at least one of, (iv) when the power-take-off is activated and the transmission is in park, controlling the fan speed according to an alternate coolant temperature table, (v) when the throttle command is zero and rotational speed of the primary energy source is above a predetermined maximum threshold, setting the zero-throttle fan speed determination at maximum and including such zero-throttle fan speed determination in the current set of minimum fan speed determinations, and (vi) when the air conditioning system of the vehicle is activated, setting the air-conditioner-on fan speed at a predetermined minimum speed and including such air-conditioner-on fan speed determination in the current set of minimum fan speed determinations.

In preferred embodiments, the method includes holding the most recent set of determinations of minimum fan speeds in a memory device and thereby developing a set of minimum fan speeds representing the most current fan speed determinations.

In preferred embodiments, the primary energy source comprises an internal combustion engine and the fan is disposed between the coolant radiator and the engine, such that the fan draws ambient air from in front of the engine and blows the air rearwardly about the engine.

Further to preferred embodiments, the fan comprises a viscous clutch fan, and the method includes sending the fan actuation signal to an actuator controlling actuation of a viscous clutch associated with the fan.

The method preferably includes, when the power-take-off is activated and the transmission is in park, controlling the fan speed according to a higher coolant temperature table than when the transmission is in a gear designed to cause movement of the vehicle.

The method also preferably includes, when the throttle command is zero, setting the fan speed at maximum when engine rotational speed is at least 1800 rpm, preferably at least 2000 rpm, more preferably at least 2400 rpm.

The method further preferably includes, when the throttle command is zero and rotational speed of the engine is above 2200 rpm, setting the fan speed at maximum.

The method further preferably includes, when vehicle speed is in excess of 50 km/hr and throttle command is low, setting the fan speed at maximum.

In some embodiments, when the air conditioning system of the vehicle is activated and the engine speed is insufficient to drive the fan at the predetermined minimum speed, which is preferably about 1200 rpm, employing an engine management system to increase the throttle setting sufficient to provide the predetermined minimum fan speed at the maximum fan speed setting.

In a second family of embodiments, the invention comprehends a control system for use in a vehicle having an internal combustion engine and a transmission, the engine having a primary cooling fan having a maximum fan speed. The control system comprises an electronic fan control unit controlling speed of rotation of the fan at speeds at and less than the maximum fan speed; a communications link connecting the electronic fan control unit to the primary cooling fan and adapted to communicate control signals from the electronic fan control unit to the primary cooling fan; and a plurality of sensors, supplying sensor data to the electronic fan control unit and thereby providing heat-related information to the fan control unit. The sensors include at least one of (i) a power-take-off sensor sensing power-take-off activation and a transmission sensor sensing whether the transmission is in park, (ii) a throttle sensor sensing throttle command and an engine speed sensor sensing engine speed, and (iii) a fan speed sensor sensing fan speed and an air conditioning sensor sensing when an air conditioning system of the vehicle is activated.

In some embodiments, the plurality of sensors comprises a power-take-off sensor and a transmission sensor, both supplying sensor data to the electronic fan control unit.

In some embodiments, the plurality of sensors comprises a throttle sensor and an engine speed sensor, both supplying sensor data to the electronic fan control unit.

In some embodiments, the plurality of sensors comprises a fan speed sensor and an air conditioning system sensor, both supplying sensor data to the electronic fan control unit.

In preferred embodiments, the primary cooling fan comprises a viscous clutch fan drive mechanism.

Preferred implementations of the invention are embodied in off-road agricultural crop-manipulation or soil-manipulation vehicles, such as tractors and combines, incorporating control systems of the invention.

Preferred implementations of the invention are further embodied in over-the-road vehicles, such as trucks and buses.

Figure 1:
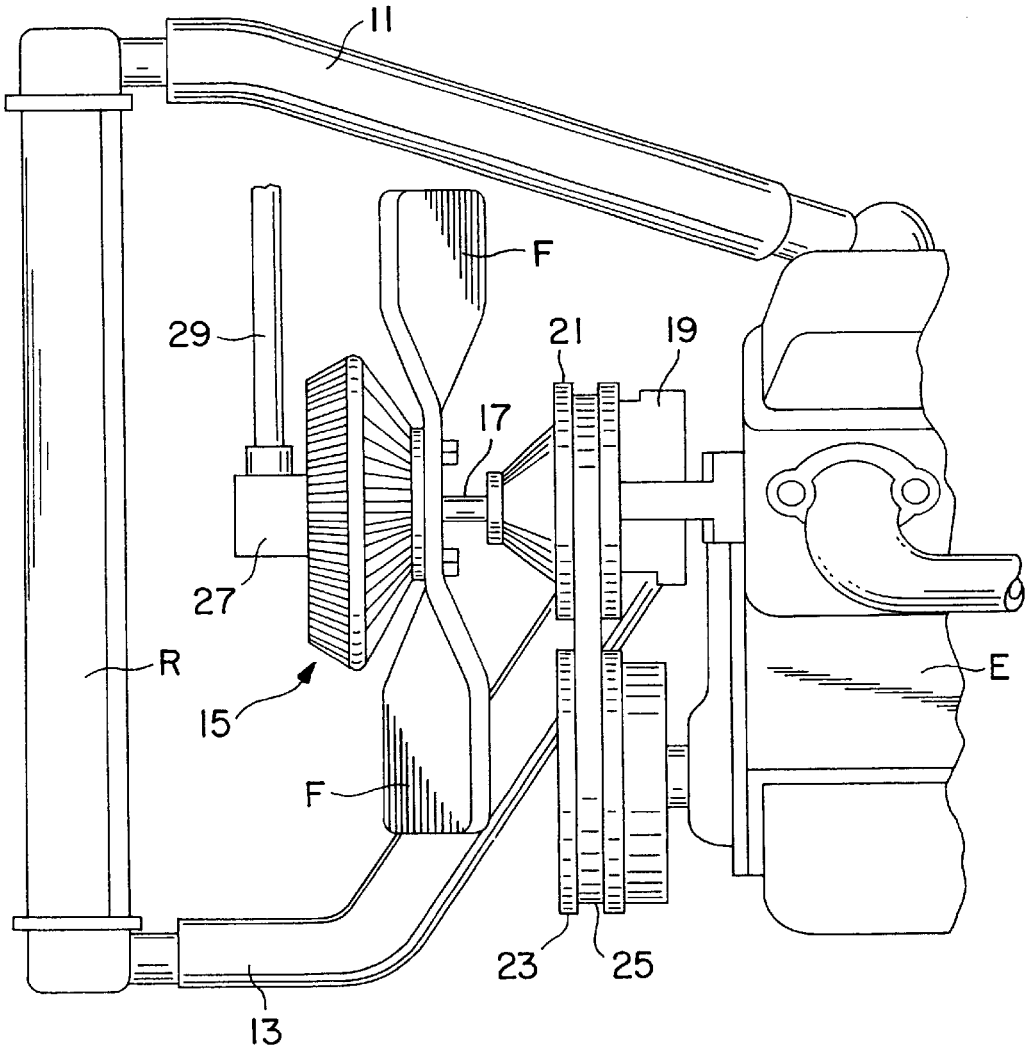
FIG. 1 shows a somewhat pictorial side elevation view of a vehicle engine cooling system of the type to which the present invention relates.

The invention is not limited in its application to the details of construction or the arrangement of the components set forth in the following description or illustrated in the drawings. The invention is capable of other embodiments or of being practiced or carried out in other various ways. Also, it is to be understood that the terminology and phraseology employed herein is for purpose of description and illustration and should not be regarded as limiting. Like reference numerals are used to indicate like components.

DESCRIPTION OF THE PREFERRED EMBODIMENT

Referring now to the drawings, which are not intended to limit the invention, but rather to illustrate the invention to FIG. 1 is a somewhat pictorial view of a vehicle engine cooling system of the type which may be used, by way of example only, on an agricultural vehicle, an off-road construction vehicle, a truck, or an automobile. The system includes an internal combustion engine "E" and a radiator "R," interconnected by hoses 11 and 13 in the usual manner. Thus, fluid coolant can flow from the engine "E" through the hose 11, then through the radiator "R," and return through the hose 13 to engine "E." A viscous fan drive, such as a viscous clutch coupling, generally designated 15, includes an input shaft 17 mounted to an engine coolant pump 19 for rotation therewith. Input shaft 17 and pump 19 are driven, by means of a pair of pulleys 21, 23, by means of a V-belt 25, as is well known in the art. An actuator assembly 27 is mounted on the front side (left hand side in FIG. 1) of the viscous coupling clutch 15. An input signal for controlling fan speed is transmitted to the actuator 27 by means of a plurality of electrical leads (not shown) disposed within a conduit 29. Bolted to the rearward side of the viscous coupling clutch 15 is a radiator cooling fan "F," including a plurality of fan blades, also designated "F."

Figure 2:
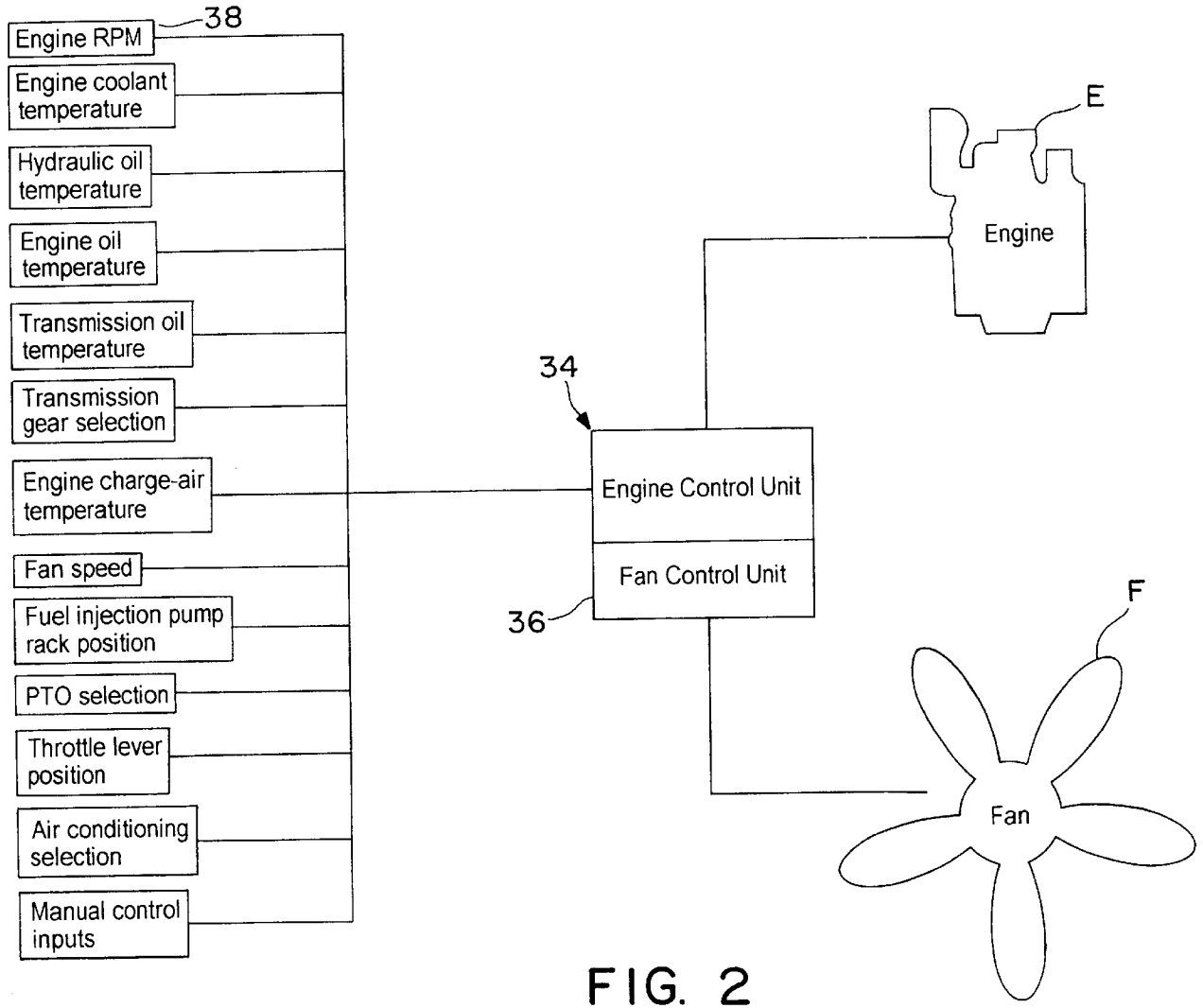
FIG. 2 shows a schematic representation of an engine control system of the invention.

Referring now to FIG. 2, engine "E" is electronically connected to an engine management system 34 into which is incorporated a fan control unit 36 as part of the engine management system. In the alternative, the fan control unit can be a separate element, which is in communication with the engine management system. Fan control unit 36 is used to monitor and control the operation of viscous clutch 15 which drives fan "F." Fan control unit 36 receives ongoing inputs 38, typically through engine management system 34. Such inputs are repeated at regular intervals, and represent a variety of operating conditions in the vehicle, which operating conditions relate to heat conditions in and around the engine compartment.

Based on the composite of such inputs, and a set of predetermined operating parameters programmed into fan control unit 36, the fan control unit determines a desired fan rotational speed and transmits a signal representing such desired fan speed to actuator 27 at fan "F." The fan control unit, optionally through engine management system 34, regularly monitors the actual rotational speed of the fan, regularly re-determines the desired speed of the fan, regularly compares the current speed of the fan to the most recently determined desired speed of the fan, computes a variance therefrom, and regularly up-dates the fan speed control signal being sent to actuator 27, in accord with the desired speed of the fan and the actual speed of the fan. The fan control unit thus provides a regular and ongoing stream of signals to actuator 27, thus controlling the rotational speed of fan "F." As the inputs to control unit 36 change, the output from the control unit to actuator 27 changes, thus to change the fan speed in accord with the changing inputs.

Fan "F" is driven by shaft 19 which is locked to pulley 21, which is driven by belt 25 which is driven by engine "E". Thus, at any point in time, the maximum speed at which the fan can be driven is that speed available at pulley 21. The speed available at pulley 21 is limited by the rpm output of engine "E." Thus, the maximum speed at which the fan can be driven depends on engine speed, and is a lesser maximum speed at idle than when the engine is operating at full throttle, or some place between idle and full throttle. Whatever the maximum speed available at pulley 21, the only control available to fan control unit 36 is to operate the fan speed at the maximum available speed as set by engine speed, or to operate the fan at a speed less than the maximum available speed. Where the maximum fan speed is insufficient to respond to the speed requirements of fan control unit 36, the fan control unit can send a signal to engine management system 34 requesting an increased throttle setting sufficient to enable a maximum fan speed at least as great as the speed being requested by the fan control unit.

Turning now to some of the detail illustrated in FIG. 2, a number of sensors feed to engine management system 34, and accordingly to fan control unit 36, information relating to the dynamic operating conditions of the vehicle. The fan control unit being illustrated in FIG. 2 is an off-road agri cultural vehicle such as an agricultural tractor. As illustrated in FIG. 2:

engine rpm is monitored and fed to the fan control unit;

Engine coolant temperature is monitored and fed to the fan control unit;

Hydraulic oil temperature is monitored and fed to the fan control unit;

Engine oil temperature is monitored and fed to the fan control unit;

Transmission oil temperature is monitored and fed to the fan control unit;

Transmission gear selection is monitored and sent to the fan control unit;

Engine charge air temperature is monitored and sent to the fan control unit;

Fan speed is monitored and sent to the fan control unit;

Fuel injection pump rack position is monitored and sent to the fan control unit;

Power-take-off selection of "on" or "off" is monitored and sent to the fan control unit;

The throttle position is monitored and sent to the fan control unit;

The air conditioner selection of "on" or "off" is monitored and sent to the fan control unit;

Manual control inputs are monitored and sent to the fan control unit e.g. for diagnostic purposes.

As suggested in FIG. 2, the above sensor inputs are fed to the fan control unit in parallel. The fan control unit processes the respective inputs individually and according to preprogrammed algorithms, and makes determinations regarding the fan speed being demanded according to each input, or according to respective sets of inputs where more than one input is used in determining a fan speed demand, and thus calculates an array of fan speed demands, each generally concurrent in time and generally each requesting a different fan speed. As the fan control unit determines fan speed requirements from the respective inputs, the respective speed requirements are stored in temporary memory in the controller, and remain in such temporary memory until such time as a new fan speed demand is determined for that input or set of inputs. Each such fan speed demand is the minimum fan speed which is acceptable for that particular input or set of inputs.

In addition to the demands determined according to the individual inputs to the fan control unit, the algorithms used in calculating fan speed demands can consider multiple concurrent inputs which provide additive demands on the cooling capacity of fan "F," whereby a speed demand so calculated can be greater than the speed demands calculated as a result of any one input.

Yet further, in accord with algorithms active in the fan control unit, the fan control unit can combine multiple inputs in arriving at a fan speed demand. Certain new fan speed controls are employed in fan control units of the invention. Thus, when the air conditioning system is turned on, an added heat dissipation load is imposed on the air conditioning system, which is cooled by fan "F." Accordingly, in this invention, when the air conditioning unit is turned on, fan control unit "F" implements a minimum fan speed to maintain proper cooling for the air conditioning system. Depending on the size of the fan, the heat load placed on the air conditioning system by its operation, preferred minimum fan speeds typically range between about 800 rpm and about 1600 rpm, with more preferred minimum fan speeds being about 1000 rpm to about 1400 rpm. A most preferred minimum fan speed, with the air conditioning system turned "on" is about 1200 rpm. Of course, if a greater fan speed is being demanded according to a calculation resulting from a different input, then that greater fan speed is implemented instead of the minimum fan speed being demanded by the air conditioning "on" signal.

Further, when the throttle command is at zero and engine speed is at a relatively higher speed, fan control units of the invention run the fan at maximum speed, thereby drawing engine power and slowing the engine down. In preferred embodiments, the threshold engine speed, which triggers activation of the fan when throttle demand is zero, is about 1800 rpm to about 2600 rpm, preferably about 2000 rpm to about 2400 rpm, more preferably about 2200 rpm. Thus, if the engine speed is e.g. greater than 2200 rpm and the fan is not running at maximum speed, if the throttle demand is suddenly changed to zero, the fan control will instruct the fan to run at maximum speed. The running of the fan at maximum speed draws power from the engine. As the engine speed slows down, so does the maximum fan speed. When the engine speed drops below the threshold speed of e.g. 2200 rpm, the fan drive demand according to engine speed is withdrawn whereupon the speed demand for the fan is controlled by a different parameter, whichever has the greatest demand according to fan control unit 36. Of course, if in the course of the engine slowing down, a second parameter requires that fan speed be maintained at maximum speed, that second parameter will control.

Alternatively, the fan speed can be set in response to vehicle speed rather than engine rpm. For example it may be desired to set the fan speed at maximum in response to conditions wherein the vehicle speed is in excess of 50 km/hr and the engine is operating under low fueling conditions, thereby slowing the engine due to increase load caused by the fan.

Further to control units of the invention, when the power-take-off unit (PTO) is engaged, and the vehicle transmission is in Park, engine management system 34 uses an alternate desired coolant temperature table allowing for a higher coolant temperature than when the vehicle is in gear for movement along the ground, whereby the fan control unit determines fan speed in accord with coolant demand according to the alternate desired coolant temperature table. If a threshold maximum temperature is crossed, the fan is operated at maximum speed until the coolant temperature is less than the threshold temperature.

By using a higher coolant temperature while the vehicle is operating under somewhat more controlled conditions, one can benefit from the higher efficiency of vehicle operation at higher operating temperatures without the risk of overheating the vehicle due to unanticipated increases in the load applied to the vehicle.

At any given point in time, the fan control unit selects that determined fan speed, including from those most-current determined speeds being stored in temporary memory, which represents the greatest fan speed in the current array of determined fan speeds, and sends a control signal to fan "F" corresponding to the selected fan speed. That control signal controls the speed of the fan until such time as a different fan speed becomes the greatest determined fan speed. For example, a greater fan speed may be subsequently determined according to the same input parameter (s). In the alternative, a greater fan speed may be subsequently determined according to a different input parameter. Further, the controlling input may be re-determined at a lower value whereby the fan speed is reduced to the lower value. Still further, the controlling input may be re-determined at a lower value whereby the fan speed is reduced to a lesser value higher than the lower value of the controlling input and controlled by a different input parameter.

The above described monitoring uses conventional sensors, transducers, receivers and like control instrumentation to collect and process the respective information which is being sent to fan control unit 36. In some cases, the sensor output is first routed to a unit of the engine management system other than the fan control unit, and the relevant information is subsequently sent to the fan control unit.

In some cases, as with the gear selection or air conditioning selection, the fan control unit takes no action unless a certain type of signal is transmitted, such as the air conditioning unit being turned on. Where such signal is required to initiate action by the fan control unit, and where such action signal is not always being transmitted, a negative signal can optionally be transmitted to confirm to the fan control logic that the absence of a signal does not represent a failure of the sending unit. In the alternative, the sending unit and the fan control unit can be programmed to send such signals only when such signal requires the fan control unit to initiate action.

The fan control unit, through a plurality of sensors, monitors various heat-related conditions which are then used in determining the desired fan speed. The operating parameters programmed into the control unit are based on one or more arbitration algorithms. Controller 36 uses the algorithms, in combination with the sensed inputs received from the various vehicular sources, and modulates a signal to fan actuator 27 on the viscous clutch to drive the fan at the desired fan speed.

During operation of a vehicle under heavy load conditions, the heat dissipation parameter typically controlling fan speed is engine coolant temperature. In larger engines such as in large agricultural vehicles, engine coolant temperature under heavy load is preferably maintained at or about 93 degrees C. at the radiator top tank. If the engine coolant temperature exceeds the desired temperature at the instantaneous engine operating speed, the fan control unit commands fan speed to increase. If the coolant temperature exceeds a predetermined threshold temperature, the fan operates at the maximum possible speed. The maximum possible speed is the speed of rotation of pulley 21, less friction losses in viscous clutch 15 when the clutch is operating with minimum possible slippage.

Typically, and under normal operating conditions under substantial load, the greatest demand on fan speed is the engine coolant temperature, with the fan speed being controlled to produce a desired coolant temperature at the radiator tank top of e.g. about 90 degrees C. to about 95 degrees C., with a preferred temperature of about 93 degrees C. The charge air temperature is the controlling factor only if the charged air temperature exceeds a high temperature limit.

If the transmission oil temperature reaches a lower temperature threshold such as during transport operation when the transmission gears are turning at a high speed in the oil and creating friction heat, and another system is not already controlling the fan fast enough for the demanded transmission cooling, the fan control unit will start controlling the fan speed according to the transmission oil temperature. If the transmission oil temperature exceeds an upper threshold temperature, the fan will operate at the maximum possible speed.

Manual control of the fan can also be fed through the fan control unit, thus to do e.g. diagnostic testing and to enable service technicians to make and adjust fan speed adjustments, as well as to run the fan at e.g. 90% to 100% of rated engine speed for testing and diagnostic purposes.

The benefits of the invention will be clear to those skilled in the art, but for refreshment are set forth as follows. First the power transfer to the fan for engine cooling is always the minimum which is required. Accordingly, at all times the optimum amount of power is available to do other productive work of the vehicle. Second the engine always operates at more efficient operating temperatures than could previously be determined and maintained, resulting in better fuel efficiency. Further, with fan power consumption reduced, more power is available to do other vehicular work. The lower energy requirement of the fan during normal operations results in lower fuel consumption and less wasted energy.

As used herein, "heat related information" means any information or sensor output which represents a thermal condition or property, or which can be used to affect, change, or control a heat condition or property, of the vehicle by changing the speed of the fan.

As used herein, "park" as related to the vehicle transmission, refers to a selected condition of the gearing of the transmission which prevents rolling movement of the vehicle.

As used herein, a statement of supplying sensor data to fan control unit 36, or command signals from fan control unit 36, includes supplying such sensor data or command signals through engine management system 34.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having described the preferred embodiment, it will become apparent that various modifications can be made without departing from the scope of the invention as defined in the accompanying claims.

What is claimed is:

1. A method of controlling rotational speed of a cooling fan positioned to provide primary cooling to at least one of an engine, vehicular fluids, or vehicular accessories in a motor vehicle having a primary energy source, and a transmission, the method comprising:

(a) supplying sensor data from multiple sensors sensing heat-related information, to a fan control unit, the sensor data including at least one of (i) power-take-off activation and whether the transmission is in park, (ii) throttle command and engine speed, and (iii) fan speed and when an air conditioning system of the vehicle is activated;

(b) receiving the sensor data into the fan control unit and processing the sensor data according to one or more pre-programmed algorithms, and thereby determining minimum fan speed demands according to respective individual data inputs as well as according to data representing selected sets of data inputs from respective different data sensors and thereby developing a set of minimum fan speed determinations;

(c) selecting from the set of most current fan speed determinations, that fan speed determination which represents the greatest fan speed;

(e) sending, to an actuator on the fan, a fan actuation signal corresponding to the selected fan speed thereby to activate control of the fan to the selected fan speed, the method further comprising at least one of, when the power-take-off is activated and the transmission is in park, controlling the fan speed according to an alternate coolant temperature table, when the throttle command is zero and rotational speed of the primary energy source is above a predetermined maximum threshold, setting the zero-throttle fan speed determination at maximum and including such zero-throttle fan speed determination in the current set of minimum fan speed determinations, and when the air conditioning system of the vehicle is activated, setting the air-conditioner-on fan speed at a predetermined minimum speed and including such air-conditioner-on fan speed determination in the current set of minimum fan speed determinations.

2. A method as in claim 1 wherein the primary energy source comprises an internal combustion engine and wherein the fan is disposed between a coolant radiator and the internal combustion engine, such that the fan draws ambient air from in front of the engine and blows the air rearwardly about the engine.

3. A method as in claim 1 wherein the fan comprises a viscous clutch fan, and including sending the fan actuation signal to an actuator controlling actuation of a viscous clutch associated with the fan.

4. A method as in claim 1 including, when the power-take-off is activated and the transmission is in park, controlling the fan speed according to a higher coolant temperature table than when the transmission is in a gear designed to cause movement of the vehicle.

5. A method as in claim 1, including holding the most recent set of determinations of minimum fan speeds in a memory and thereby developing a set of minimum fan speeds representing the most current fan speed determinations.

6. A method as in claim 5 including, when the throttle command is zero, setting the fan speed at maximum when engine rotational speed is at least 1800 rpm.

7. A method as in claim 5 including, when the throttle command is zero, setting the fan speed at maximum when engine rotational speed is at least 2000 rpm.

8. A method as in claim 5 including, when the throttle command is zero, setting the fan speed at maximum when engine rotational speed is at least 2400 rpm.

9. A method as in claim 5 wherein, when the throttle command is zero and rotational speed of the engine is above 2200 rpm, setting the fan speed at maximum.

10. A method as in claim 9 wherein, when the air conditioning system of the vehicle is activated and the engine speed is insufficient to drive the fan at the predetermined minimum speed, employing an engine management system to increase the throttle setting sufficient to provide the predetermined minimum fan speed at the maximum fan speed setting.

11. A method as in claim 5 wherein, when vehicle speed is in excess of 50 km/hr and throttle command is low, setting the fan speed at maximum.

12. A control system for use in a vehicle having an internal combustion engine and a transmission, the engine having a primary cooling fan having a maximum fan speed, said control system comprising:

(a) an electronic fan control unit controlling speed of rotation of the fan at speeds at and less than the maximum fan speed;

(b) a communications link connecting said electronic fan control unit to said primary cooling fan and adapted to communicate control signals from said electronic fan control unit to said primary cooling fan; and (c) a plurality of sensors, supplying sensor data to said electronic fan control unit and thereby providing heat-related information to said fan control unit, the sensors including at least one of (i) a power-take-off sensor sensing power-take-off activation and a transmission sensor sensing whether the transmission is in park, (ii) a fan speed sensor sensing fan speed and an air conditioning sensor sensing when an air conditioning system of the vehicle is activated.

13. A control system as in claim 12, said plurality of sensors comprising a power-take-off sensor and a transmission sensor, both supplying sensor data to said electronic fan control unit.

14. A control system as in claim 12, said plurality of sensors comprising a fan speed sensor and an air conditioning system sensor, both supplying sensor data to said electronic fan control unit.

15. A control system as in claim 12 wherein said primary cooling fan comprises a viscous clutch fan drive mechanism.

16. An off-road agricultural crop-manipulation or soil-manipulation vehicle incorporating a control system of claim 12.

17. A vehicle as in claim 16 wherein said vehicle is an agricultural tractor.

18. A vehicle as in claim 16 wherein said vehicle is an agricultural combine.

19. An over-the-road transport vehicle incorporating a control system of claim 12.

20. A vehicle as in claim 19 wherein said vehicle is a bus.

21. A vehicle as in claim 19 wherein said vehicle is a truck.

* * * * *